US010867782B2

(12) United States Patent
Kodera et al.

(10) Patent No.: US 10,867,782 B2
(45) Date of Patent: Dec. 15, 2020

(54) TIME-OF-FLIGHT MASS SPECTROMETER

(71) Applicant: SHIMADZU CORPORATION, Kyoto (JP)

(72) Inventors: Kei Kodera, Kyoto (JP); Masaji Furuta, Kyoto (JP)

(73) Assignee: SHIMADZIJ CORPORATION, Kyoto (JP)

( * ) Notice: Subject to any disclaimer, the term of this patent is extended or adjusted under 35 U.S.C. 154(b) by 0 days.

(21) Appl. No.: 16/244,234

(22) Filed: Jan. 10, 2019

(65) Prior Publication Data

US 2020/0227246 A1 Jul. 16, 2020

(51) Int. Cl.

| | |
|---|---|
| ***H01J 49/40*** | (2006.01) |
| ***H01J 49/14*** | (2006.01) |
| ***H01J 49/04*** | (2006.01) |
| ***H01J 49/16*** | (2006.01) |

(52) U.S. Cl.

CPC ..... *H01J 49/401* (2013.01); *H01J 49/0409* (2013.01); *H01J 49/14* (2013.01); *H01J 49/164* (2013.01); *H01J 49/40* (2013.01)

(58) Field of Classification Search

CPC ..... H01J 49/14; H01J 49/164; H01J 49/0459; H01J 49/0463; H01J 49/04; H01J 49/401; H01J 49/0409

See application file for complete search history.

(56) References Cited

U.S. PATENT DOCUMENTS 5,214,342 A * 5/1993 Yang ..... H02N 2/023 250/442.11
5,260,577 A * 11/1993 Abraham ..... H01J 37/20 250/307
2008/0272286 A1* 11/2008 Vestal ..... B08B 1/00 250/282

(Continued)

FOREIGN PATENT DOCUMENTS

JP 49-42752 Y 11/1974
JP 4242752 Y * 11/1974 ..... G21B 5/00
JP 2007-257851 A 10/2007

(Continued)

OTHER PUBLICATIONS

"LM Guide". THK Co., Ltd., Apr. 2016, <URL: http://www.thk.com/?q=jp/node/6709>.

(Continued)

*Primary Examiner* — David E Smith
(74) *Attorney, Agent, or Firm* — Sughrue Mion, PLLC

(57) ABSTRACT

A metallic plate holder 3 is directly placed on a flat bottom plate 1*a* of a sample chamber. A linear guide 21 extending in x-direction is located below the bottom plate. Another linear guide 22 extending in y-direction is fixed to a movable part 21*a* of the linear guide 21. A magnet 23, fixed to a movable part 22*a* of the linear guide 22, magnetically attracts the plate holder across the bottom plate. When the magnet is two-dimensionally driven by the linear guides, the plate holder follows it and moves two-dimensionally. The (Continued)

flat bottom plate limits the z-position of the plate holder, thereby reducing the fluctuation in the level of the sample on a sample plate 2 due to the movement. Thus, the variation in the level at different positions on the sample plate is reduced, so that the number of times of a calibrant measurement can be decreased.

4 Claims, 4 Drawing Sheets

(56) References Cited

U.S. PATENT DOCUMENTS

| | | | | |
|---|---|---|---|---|
| 2010/0090101 | A1* | 4/2010 | Schultz | H01J 49/0481 250/282 |
| 2014/0268134 | A1* | 9/2014 | O'Connor | H05H 1/30 356/318 |

FOREIGN PATENT DOCUMENTS

| | | | |
|---|---|---|---|
| JP | 2015-179017 | A | 10/2015 |
| JP | 2015-179630 | A | 10/2015 |
| JP | 2016-517523 | A | 6/2016 |
| WO | 2014/143888 | A1 | 9/2014 |
| WO | 2014/147260 | A1 | 9/2014 |

OTHER PUBLICATIONS

Communication dated Sep. 3, 2019 from Japanese Patent Office in counterpart JP Application No. 2016-128299.

* cited by examiner

TIME-OF-FLIGHT MASS SPECTROMETER

TECHNICAL FIELD

The present invention relates to a time-of-flight mass spectrometer, and more specifically, to a time-of-flight mass spectrometer including an ion source which ionizes components in a sample by irradiating the sample with a laser beam, electron beam, ion beam, neutral atomic beam, or similar beam.

BACKGROUND ART

Matrix-assisted laser desorption/ionization (MALDI) is commonly known as one type of technique for ionizing components in a solid sample by irradiating the sample with a laser beam. A typical operation of a time-of-flight mass spectrometer which includes an ion source employing the MALDI method (such a device is hereinafter called the "MALDI-TOFMS" according to conventional usage) is as follows: A sample held on a flat sample plate is irradiated with a pulsed laser beam to generate ions originating from the components contained in the sample. An electric field is created by an electrode located above the sample to impart a specific amount of acceleration energy to the various ions mentioned earlier and introduce them into a flight space. The period of time required for an ion to fly a specific distance within the flight space and reach a detector is measured for each of those ions. The time of flight of each ion has a predetermined relationship with the mass-to-charge ratio of the ion. Using this relationship, the measured time of flight is converted into the mass-to-charge ratio to create, for example, a mass spectrum showing the relationship between the mass-to-charge ratio and the ion intensity.

In a normal type of MALDI-TOFMS, a large number of concave portions, called the "wells", for the spotting of samples as the measurement targets are formed in rows and columns on the sample plate (in some cases, no concave portion is present, and the spotting positions are simply marked). A liquid sample is spotted in each well and dried to form a sample. This sample plate is attached to a plate holder, and this plate holder is driven in two axial directions orthogonal to each other in a horizontal plane to transfer the sample in the desired well to the laser irradiation point and perform a mass spectrometric analysis on the sample (for example, see Patent Literature 1).

FIGS. 5A-5C schematically shows the configuration of a sample-plate drive mechanism in a conventional MALDI-TOFMS. Specifically, FIG. 5A is a front view, FIG. 5B is a side view, and FIG. 5C is a top view. As shown in FIG. 5C, the horizontal plane on which the sample plate 2 is the plane of the x-axis and the y-axis. The direction in which the ions generated by the laser irradiation begin to fly is the z-axis direction.

As shown in FIGS. 5A-5C, a first linear guide 51 extending in the x-axis direction is attached to the upper surface of the bottom plate 1*a* of a sample chamber. A movable part 51*a* mounted on the first linear guide 51 is linearly movable along this guide. A second linear guide 52 extending in the y-axis direction is fixed to the movable part 51*a*. Another movable part 52*a*, which is mounted on the second linear guide 52, is also linearly movable along this guide. A plate holder 3 capable of holding a sample plate 2 is fixed to the movable part 52*a* The movable part 51*a* of the first linear guide 51 and the movable part 52*a* of the second linear guide 52 are each driven by the power of a motor or similar driving device (not shown), thereby allowing for the transfer of the plate holder 3 to a desired position within a predetermined two-dimensional range. As the linear guides 51 and 52, for example, a system disclosed in Non-Patent Literature 1 can be used.

In the previously described MALDI-TOFMS, the surface of a sample on the sample plate 2 corresponds to the point from which ions begin to fly. Therefore, if the level of the upper surface of the sample plate 2 changes due to various factors, a slight change in the flight distance occurs, which leads to an error of the mass-to-charge ratio. Accordingly, in order to correctly determine the mass-to-charge ratio of an ion originating from the target compound, it is common to correct the result of a measurement for a target sample based on the result of a measurement for a standard sample (called a "calibrant") containing a standard substance whose theoretical (i.e. correct) mass-to-charge ratio is previously known. Such a process is called the "calibration".

The flight distance can also vary depending on the in-plane position on one sample plate if the sample plate is warped or non-uniform in thickness. To deal with this problem, a calibrant well in which the calibrant is to be spotted is provided at multiple points on the sample plate in addition to the sample wells in which target samples are to be spotted. The calibration of the measurement result for one target sample is performed with reference to the measurement result obtained for a calibrant formed in a calibrant well which is the closest to the sample well in which the target sample is formed. Through such a calibration, the mass-to-charge-ratio values for sample components obtained through the measurement of the target sample are corrected to be closer to their respective true values (see Patent Literature 2).

Using a sample plate with a large number of calibrant wells means that the time required for the measurement of the calibrant becomes correspondingly long and lowers the measurement efficiency. Therefore, from the viewpoint of the measurement efficiency, it is preferable that the calibration for all target samples on one sample plate can be performed using the result of a measurement for a calibrant formed in one calibrant well on the sample plate. To this end, efforts have been made for an improved uniformity in the thickness of the sample plate, for the prevention of the warp of the plate, or for other purposes. However, in practice, the variation in the level of the sample on one sample plate, or the variation in the distance from the surface of the sample to the electrode for extracting and accelerating ions, can occur due to factors which are unrelated to the sample plate.

That is to say, as described earlier using FIGS. 5A-5C, the conventional sample-plate drive mechanism includes a plurality of members vertically stacked on the bottom plate 1*a* of the sample chamber. Therefore, the tolerances of the individual members are accumulated, so that the level of the sample plate 2 may become significantly varied depending on the position on the same plate.

FIG. 6 shows one example of the result of a measurement of the amount of change in the level of the sample plate for each position of the sample wells arrayed in one direction (x-axis direction) on the sample plate in a conventional MALDI-TOFMS. The position is indicated by the sample number #. From the viewpoint of the mass accuracy, the fluctuation should be roughly contained within a range of ±100 ppm. In the present example, there are sample wells which considerably deviate from the mentioned range. If such a large change in the level is present, it is necessary to perform the calibration based on a measurement result obtained for a calibrant located near the sample \veil concerned, and it is essential to form a plurality of calibrants on one sample plate.

CITATION LIST

Patent Literature

Patent Literature 1: JP 2015-179017 A (Paragraph [0003])
Patent Literature 2: JP 2015-179630 A (Paragraphs [0003] and [0004])

Non Patent Literature

Non Patent Literature 1: "LM Guide", THK Co., Ltd., [accessed on Apr. 25, 2016], the Internet

SUMMARY OF INVENTION

Technical Problem

The present invention has been developed to solve the previously described problem. Its objective is to provide a time-of-flight mass spectrometer in which the drive mechanism for transferring a sample plate in two axial directions orthogonal to each other does not causes a significant variation in the distance between the sample and the ion extraction-acceleration electrode, so that the number of calibrants to be formed on the sample plate for the purpose of calibration can be decreased.

Solution to Problem

A time-of-flight mass spectrometer according to the first aspect of the present invention developed for solving the previously described problem is a time-of-flight mass spectrometer configured to generate ions from a sample held by a sample holder by irradiating the sample with a laser beam or particle beam, as well as accelerate and introduce the generated ions into a flight space to separate the ions from each other according to the mass-to-charge ratios of the ions within the flight space and individually detect the ions, the time-of-flight mass spectrometer including:

a) a base plate having a flat obverse surface;

b) an orthogonal driver located on the reverse side of the base plate, the orthogonal driver being capable of transferring a moving part in two axial directions orthogonal to each other in a plane substantially parallel to the obverse surface of the base plate; and c) a magnet integrally formed in or attached to the movable part, for attracting, across the base plate, the sample holder made of a metallic material and placed on the obverse surface of the base plate.

A time-of-flight mass spectrometer according to the second aspect of the present invention developed for solving the previously described problem is a time-of-flight mass spectrometer configured to generate ions from a sample held by a sample holder by irradiating the sample with a laser beam or particle beam, as well as accelerate and introduce the generated ions into a flight space to separate the ions from each other according to the mass-to-charge ratios of the ions within the flight space and individually detect the ions, the time-of-flight mass spectrometer including:

a) a base plate having a flat obverse surface;

b) a first driver for pushing and/or pulling a side surface of the sample holder placed on the obverse surface of the base plate in one direction in a plane substantially parallel to the obverse surface of the base plate; and c) a second driver for pushing and/or pulling a side surface of the sample holder placed on the obverse surface of the base plate, in a direction which is orthogonal to the direction in which the first driver pushes and/or pulls the side surface of the sample holder in the plane substantially parallel to the obverse surface of the base plate.

Examples of the method for ionizing a component in a sample in the time-of-flight mass spectrometer according to the present invention include, in addition to the MALDI, the laser desorption/ionization (LDI), surface-assisted laser desorption/ionization (SALDI), secondary ion mass spectrometry (SIMS), desorption/ionization on silicon (DIOS), electrospray-assisted laser desorption/ionization (ELDI), and fast atom bombardment (FAB).

Examples of the sample holder in the time-of-flight mass spectrometer according to the present invention include a plate holder for holding a sample plate, and a plate-shaped stage on which a sample is to be placed.

In the time-of-flight mass spectrometer according to the present invention, the obverse surface of the base plate may be a horizontal plane, vertical plane, or inclined plane which is neither horizontal nor vertical. For example, if the base plate has a horizontal obverse surface, the sample holder can be directly placed on the horizontal base plate and made to slide smoothly slide) on the upper surface of the base plate.

In order to drive the sample holder directly placed on the obverse surface of the base plate, in the first aspect of the present invention, the orthogonal driver and the magnet located on the reverse side of the base plate are used to apply magnetic force of the magnet to the sample holder to two-dimensionally drive the sample holder in a contactless manner. On the other hand, in the second aspect of the present invention, the first and second drivers located on the obverse side of the base plate are used to apply force to the side surface of the sample holder to two-dimensionally drive the sample holder.

In any of the first and second aspects of the present invention, the obverse surface of the base plate functions as a type of guide which limits the position of the sample holder in the direction orthogonal to the two axial directions (i.e. in the thickness direction of the base plate) when the sample holder is driven in those two axial directions. Accordingly, the amount of fluctuation of the distance between the sample and the ion extraction-acceleration electrode which accompanies the movement of the sample holder can be reduced by improving the flatness of the obverse surface of the sample plate.

In the time-of-flight mass spectrometer according to the present invention, the base plate may be a bottom plate of a sample chamber in which a sample is to be contained. In the case where an ionization method in which the ionization is performed in vacuum atmosphere is used, the sample chamber is configured to be hermetically sealable so that its inner space can be evacuated during the mass spectrometric operation.

Advantageous Effects of Invention

In the time-of-flight mass spectrometer according to the present invention, the drive mechanism for two-dimensionally driving the sample plate on which samples are to be held does not cause a significant variation in the distance between the surface of the sample plate and the ion extraction-acceleration electrode within one sample plate, Therefore, for example, the number of calibrants to be prepared on one sample plate can be smaller than conventionally required. This shortens the time required for the measurement of the calibrants and improves the measurement efficiency, as well as eliminates the necessity to prepare a large number of calibrants.

BRIEF DESCRIPTION OF DRAWINGS

FIG. 2A is a front view, FIG. 2B is a side view, and FIG. 2C is a top view.

FIG. 3A is a front view, FIG. 33 is a side view, and FIG. 3C is a top view.

FIG. 5A is a front view, FIG. 5B is a side view, and FIG. 5C is a top view.

DESCRIPTION OF EMBODIMENTS

Figure 1:
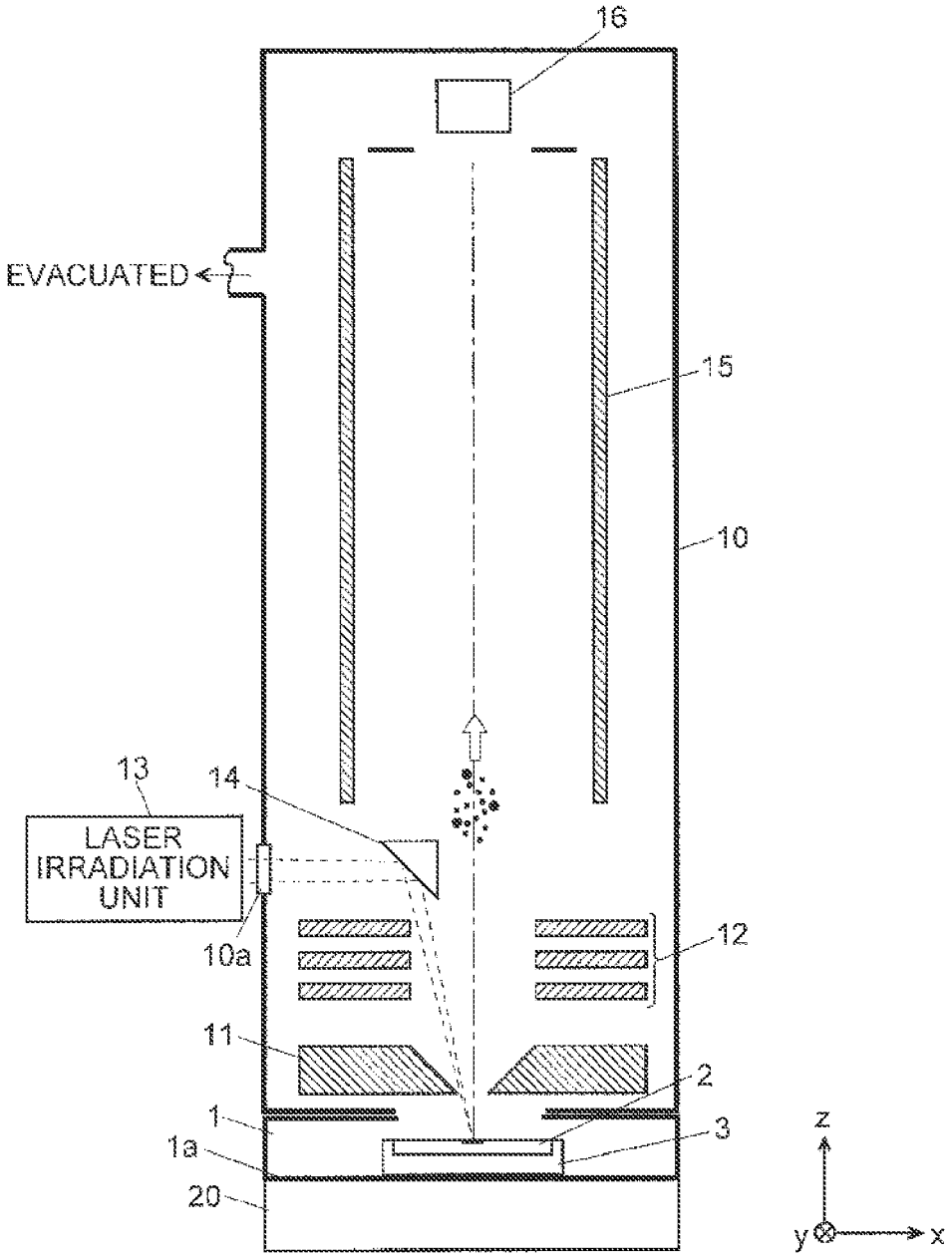
FIG. 1 is a schematic configuration diagram of a MALDI-TOFMS as one embodiment of the present invention.
Figure 2C:
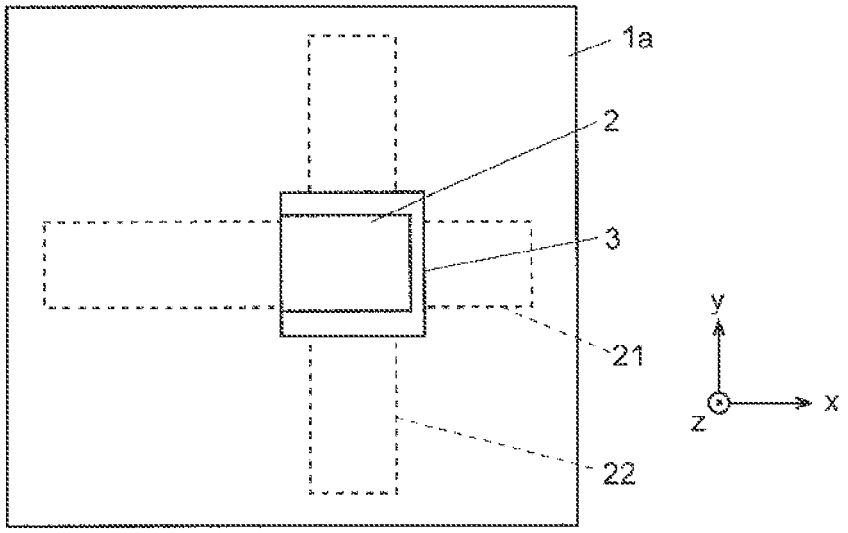
FIGS. 2A-2C are schematic configuration diagrams of a plate-holder drive mechanism in the MALDI-TOFMS according to the present embodiment, where
Figure 2A:
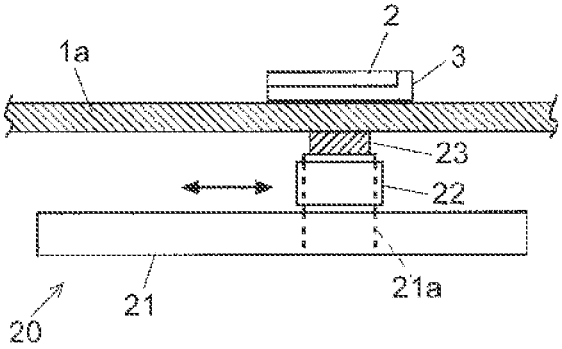
Figure 2B:
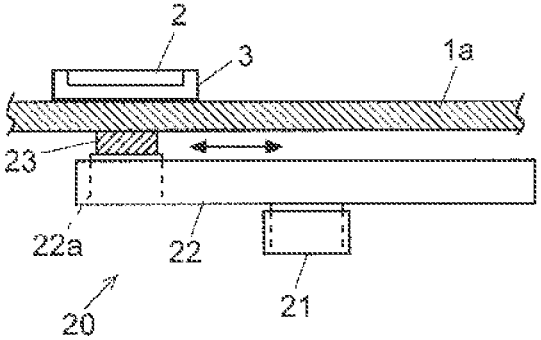

A MALDI-TOFMS as one embodiment of the present invention is hereinafter described with reference to the attached drawings. FIG. 1 is a schematic configuration diagram of the MALDI-TOFMS according to the present embodiment. FIGS. 2A-2C are schematic configuration diagrams of a plate-holder drive mechanism in the MALDI-TOFMS according to the present embodiment. Similar to FIGS. 5A-5C, FIG. 2A is a front view, FIG. 2B is a side view, and FIG. 2C is a top view.

As shown in FIG. 1, a sample plate 2, which is a flat metallic plate, is attached to a plate holder 3 made of a metallic material. This holder is directly placed on a bottom plate 1*a* within a sample chamber 1. An X-Y drive mechanism 20 for two-dimensionally driving the plate holder 3 on the bottom plate 1.*a* is located below the sample chamber 1. A vacuum chamber 10 communicating with the inside of the sample chamber 1 is located above the sample chamber 1. The vacuum chamber 10 contains an extraction electrode 11, acceleration electrode 12, reflecting mirror 14, flight tube 15 and detector 16 vertically arranged from the bottom end. A laser irradiation unit 13 is provided on the outside of a window 10*a* formed in the vacuum chamber 10.

When a measurement is performed, a pulsed laser beam is emitted from the laser irradiation unit 13. After passing through the window 10*a* and being reflected by the reflecting mirror 14, the laser beam falls onto one of the samples on the sample plate 2 which is set at a predetermined laser irradiation point, whereby the components contained in the sample are ionized. The laser irradiation point is fixed, whereas the position of the sample plate 2 can be changed by appropriately driving the plate holder 3 through the X-Y drive mechanism 20. Thus, a sample at any position on the sample plate 2 can be irradiated with the laser beam to perform the measurement.

Predetermined voltages are respectively applied from a voltage generator (not shown) to the extraction electrode 11 and the acceleration electrode 12 located above the sample plate 2. Another predetermined voltage is also applied to the sample plate 2 via the plate holder 3. Due to the electric field created between the extraction electrode 11 and the sample, the ions generated from the sample irradiated with the laser beam in the previously described manner are extracted upward from an area near the site at which the ions have been generated. The extracted ions receive acceleration energy from the accelerating electric field created by the acceleration electrode 12. Thus, the ions begin to fly upward (in the z-axis direction). After flying through the field-free flight space formed within the flight tube 15, the ions reach the detector 16. Within the flight space, an ion having a smaller mass-to-charge ratio has a higher flight speed. Therefore, the various kinds of ions which have almost simultaneously begun to fly will sequentially reach the detector 16 in ascending order of mass-to-charge ratio. The detector 16 produces a detection signal according to the amount of incident ions.

The MALDI-TOFMS in the present embodiment is a linear TOFMS in which ions are made to fly linearly. Understandably, the present invention may also be applied in a reflectron TOFMS including a reflectron for reversing the flight path of the ions, or a multiturn TOFMS in which ions are made to repeatedly fly in a loop path.

A detailed description is hereinafter given of the X-Y drive mechanism 20 used in the MALDI-TOFMS according to the present embodiment to two-dimensionally drive the plate holder 3 which corresponds to the sample holder in the present invention.

As already described, the plate holder 3 is placed on the flat bottom plate 1*a* which corresponds to the base plate in the present invention. This bottom plate is made of a material that is insusceptible to magnetic force, such as non-magnetic stainless steel. Its upper surface should preferably have a high degree of flatness as well as a high degree of smoothness. To this end, the upper surface of the bottom plate 1*a* may be finished by an appropriate surface-machining or surface-treating process.

Figure 5C:
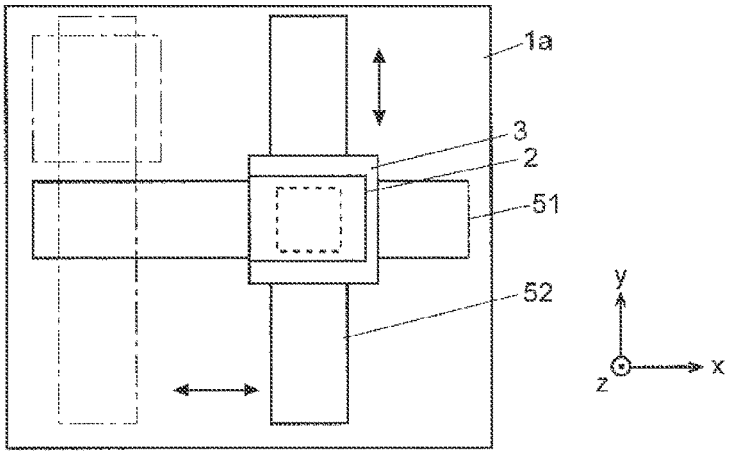
FIGS. 5A-5C are schematic configuration diagrams of a plate-holder drive mechanism in a conventional MALDI-TOFMS, where
Figure 5A:
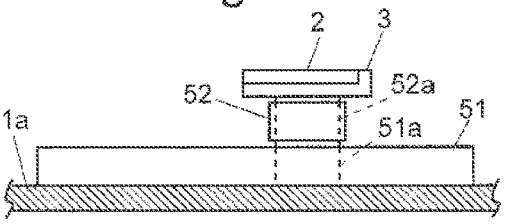
Figure 5B:
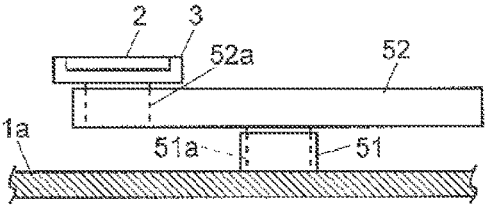
Figure 6:
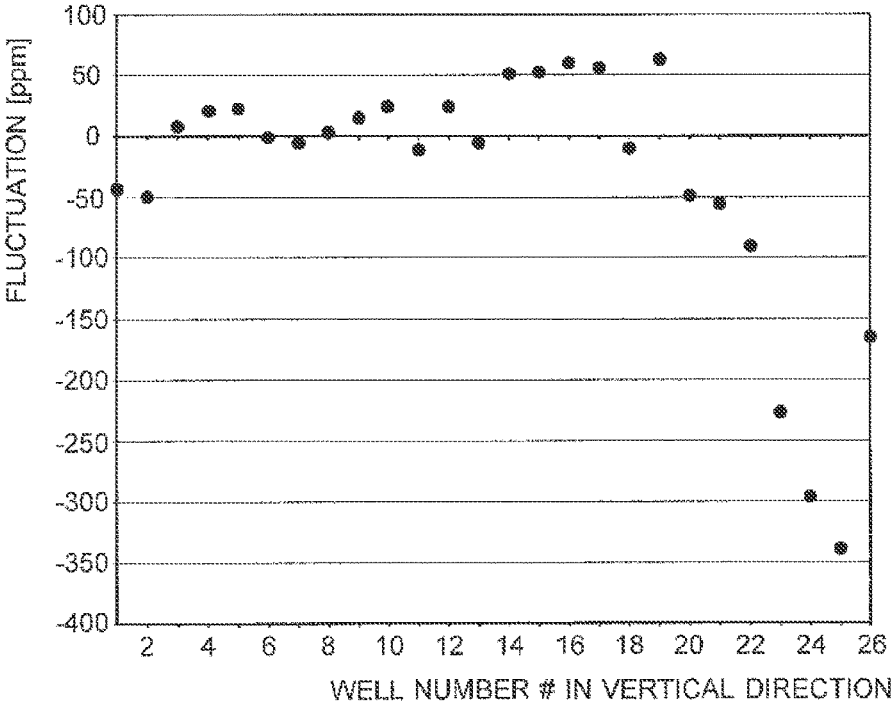
FIG. 6 is a chart showing the result of a measurement of the amount of change in the level of the sample plate at each position of the sample wells arrayed in one direction on the sample plate in a conventional MALDI-TOFMS.

As shown in FIGS. 2A and 2B, the X-Y drive mechanism 20 includes two linear guides 21 and 22, which are similar to the linear guides 51 and 52 in the conventional device shown in FIGS. 5A-5C, as the elements corresponding to the orthogonal driver in the present invention. That is to say, the first linear guide 21 extending in the x-axis direction is fixed to a bottom plate of the casing (not shown) of the X-Y drive mechanism 20, while the second linear guide 22 extending in the y-axis direction is fixed to the movable part 21*a* of the first linear guide 21. A magnet 23 is fixed to the movable part 22*a* of the second linear guide 22. The upper surface of the magnet 23 is substantially in contact with the lower surface of the bottom plate 1*a* or in close proximity to the latter surface with a slight gap in between. The movable parts 21*a* and 22*a* of the two linear guides 21 and 22 can be driven in the x-axis and y-axis directions, respectively, by the power of a motor or similar driving device (not shown). With such a mechanism, the magnet 23 can be transferred to a desired two-dimensional position in a substantially horizontal plane (i.e. the plane of the x-axis and the y-axis) underneath the bottom plate 1*a*.

The magnetic force of the magnet 23 penetrates the bottom plate 1*a* and reaches the plate holder 3 which is placed above the magnet. When the magnet 23 is two-dimensionally transferred to a desired position in the substantially horizontal plane in the previously described manner, the plate holder 3, being attracted by the magnet 23, follows the magnet 23 and changes its two-dimensional position on the bottom plate 1*a*. During the two-dimensional movement of the magnet 23, the width of the gap between the upper surface of the magnet 23 and the lower surface of the bottom plate 1*a* may possibly change to a certain extent. However, this does not hinder the sliding movement of the plate holder 3 on the bottom plate 1*a* as long as the plate holder 3 is within reach of the magnetic force of the magnet 23. This means that the entire upper surface of the bottom plate 1*a* functions as a guide which limits the position of the lower surface of the plate holder 3 in the z-axis direction during the two-dimensional movement of the same holder. Therefore, if the upper surface of the bottom plate 1*a* is extremely flat, the change in the position of the plate holder 3 in the z-axis direction during its movement will be extremely small. Thus, as compared to a conventional device, the present device will dramatically reduce the change in the level of the sample on the sample plate 2 at the laser irradiation point.

In the MALDI-TOFMS according to the present embodiment, the magnet 23 does not need to be a permanent magnet; it may also be an electromagnet. It is also possible to directly drive the sample plate 2 by magnetic force without using the plate holder 3. A sample stage consisting of a simple metallic plate on which a sample can be placed may be used in place of the plate holder 3 for holding the sample plate 2.

Figure 3C:
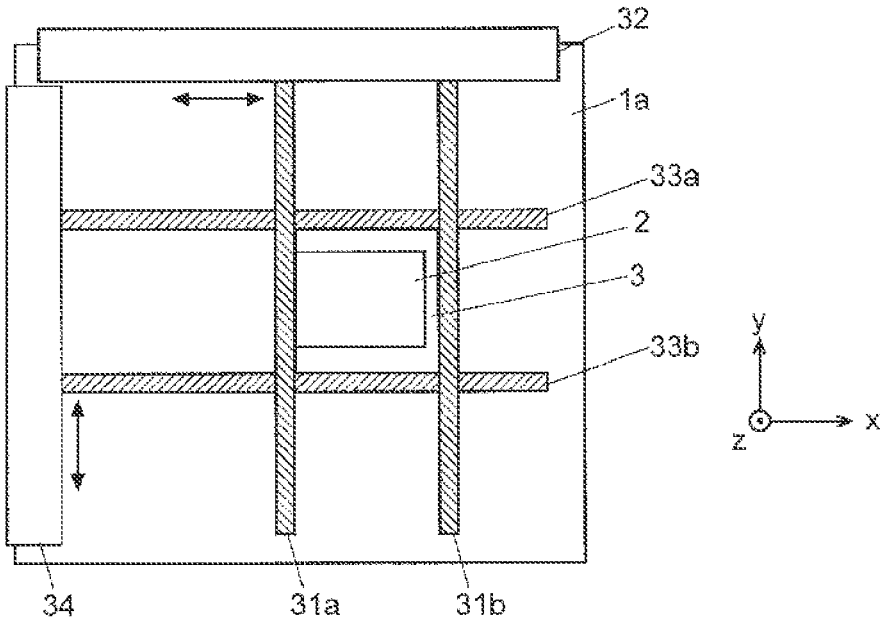
FIGS. 3A-3C are schematic configuration diagrams of a plate-holder drive mechanism in an MALDI-TOFMS according to another embodiment of the present invention, where
Figure 3A:
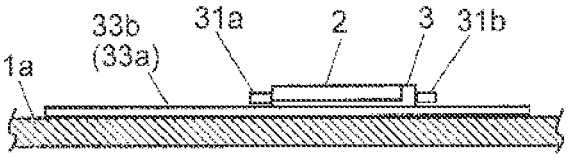
Figure 3B:
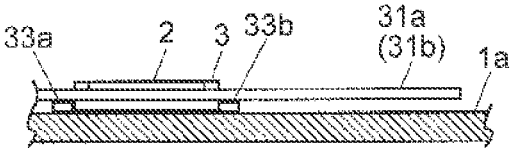

Hereinafter, a plate-holder drive mechanism in a MALDI-TOFMS according to another (second) embodiment of the present invention is described. FIGS. 3A-3C are schematic configuration diagrams of the present drive mechanism. Similar to FIGS. 2A-2C, FIG. 3A is a front view, FIG. 3B is a side view, and FIG. 3C is a top view. The same components as shown in FIGS. 2A-2C are denoted by the same reference signs.

Unlike the drive mechanism in the previous embodiment in which a magnet is used to two-dimensionally drive the plate holder 3 in a contactless manner, the drive mechanism in the present embodiment is configured to two-dimensionally drive the plate holder 3 on the bottom plate 1*a* by means of two pairs of arms which are arranged so that the plate holder 3 is sandwiched between each pair of arms. More specifically, as shown in FIGS. 3A-3C, the plate holder 3 is sandwiched between two arms 31*a* and 31*b* extending in the y-axis direction as well as between two arms 33*a* and 33*b* extending in the x-axis direction. The pair of arms 31*a* and 31*b* can be driven by an x-directional driver 32 in the x-axis direction without changing their distance. Similarly, the other pair of arms 33*a* and 33*b* can be driven by a y-directional driver 34 in the y-axis direction without changing their distance. For example, when the pair of arms 31*a* and 31*h* are driven leftward in FIG. 3A, the arm 31*b* pushes the right side of the plate holder 3, making the plate holder 3 slide leftward on the bottom plate 1*a*.

With the x-directional driver 32 and the y-directional driver 34, the present mechanism allows the first pair of arms 31*a* and 31*b* and the second pair of arms 33*a* and 33*h* to be independently driven so as to transfer the plate holder 3 to a desired position on the bottom plate 1*a*. As in the previous embodiment, the entire upper surface of the bottom plate 1*a* functions as a guide which limits the position of the lower surface of the plate holder 3 in the z-axis direction during the two-dimensional movement of the same holder. Therefore, if the upper surface of the bottom plate 1*a* is extremely flat, the change in the position of the plate holder 3 in the z-axis direction during its movement will be extremely small, and the fluctuation in the level of the sample depending on the position on the sample plate 2 will also be reduced.

Figure 4:
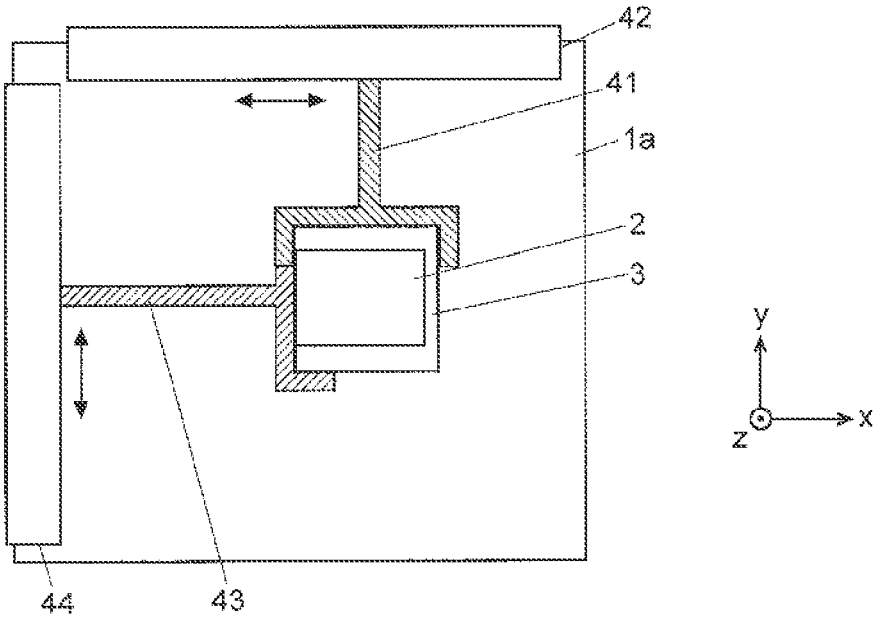
FIG. 4 is a top view showing a schematic configuration of a modified example of the drive mechanism shown in FIGS. 3A-3C.

In the example of FIGS. 3A-3C, the transfer of the plate holder 3 is achieved by pushing the circumferential surface (side surface) of the plate holder 3 from behind with one of the arms 31*a*, 31*b*, 33*a* and 33*b*. FIG. 4 shows a modified example, in which two arms 41 and 43, each of which has a gripping part for holding the plate holder 3, are respectively driven by the x-directional driver 42 and the y-directional driver 44. It is evident that any mechanism configured to drive the plate holder 3 on the bottom plate 1*a* by pushing or pulling it from its circumferential surface (side surface) can produce the same effects as described in the previous embodiment.

In any of the previous embodiments, the bottom plate 1*a* is horizontally set. It is evident that this plate does not always need to be horizontal but may be inclined or vertically set. In the case where the bottom plate 1*a* in the second embodiment is vertically set, the plate holder 3 needs to be prevented from falling off the bottom plate 1*a*. This can be achieved, for example, by magnetically attracting the plate holder 3 onto the bottom plate 1*a*.

The previous embodiment is an application of the present invention in a MALDI-TOFMS, It is evident that the present invention is generally applicable in any type of time-of-flight mass spectrometer including an ion source in which the components in a sample formed on a sample plate 2 or placed on a sample stage are ionized by irradiating the sample with a laser beam or any other kind of thin particle beam, such as an ion beam, electron beam or neutral atomic beam. Examples of such an ion source include SALDI, SIMS, DIOS, ELM and FAB.

It should be noted that the previously described embodiments are mere examples of the present invention, and any change, modification or addition appropriately made within the spirit of the present invention will evidently fall within the scope of claims of the present application.

REFERENCE SIGNS LIST

1 . . . Sample Chamber
1*a* . . . Bottom Plate
2 . . . Sample Plate
3 . . . Plate Holder
10 . . . Vacuum Chamber
10*a* . . . Window
11 . . . Extraction Electrode
12 . . . Acceleration Electrode
13 . . . Laser irradiation Unit
14 . . . Reflecting Mirror
15 . . . Flight Tube
16 . . . Detector
20 . . . X-Y Drive Mechanism
21, 22 . . . Linear Guide
21*a*, 22*a* . . . Movable Part
23 . . . Magnet
31*a*, 31*b*, 33*a*, 33*b*, 41, 43 . . . Arm
32, 42 . . . x-Directional Driver
34, 44 . . . y-Directional Driver

The invention claimed is:

1. A time-of-flight mass spectrometer comprising:

a base plate having a flat obverse surface on which a sample plate made of a metallic material or a plate holder which is made of a metallic material and configured to hold the sample plate is to be placed;

an orthogonal driver located on a reverse side of the base plate, the orthogonal driver being capable of transferring a moving part in two axial directions orthogonal to each other in a plane substantially parallel to the obverse surface of the base plate; and a magnet integrally formed in or attached to the movable part, for attracting, across the base plate, the sample plate or the plate holder, wherein:

ions are generated from a sample provided on the sample plate by irradiating the sample with a laser beam or particle beam;

the ions are accelerated and introduced into a flight space to separate from each other according to mass-to-charge ratios of the ions within the flight space and to individually detect the ions; and a reverse surface of the sample plate or the plate holder has a planar surface slidable on the obverse surface while keeping in direct contact with the obverse surface.

2. The time-of-flight mass spectrometer according to claim 1, wherein:

the base plate is a bottom plate of a sample chamber in which a sample is to be contained.

3. A time-of-flight mass spectrometer configured to generate ions from a sample held by a sample holder by irradiating the sample with a laser beam or particle beam, as well as accelerate and introduce the generated ions into a flight space to separate the ions from each other according to mass-to-charge ratios of the ions within the flight space and individually detect the ions, the time-of-flight mass spectrometer comprising:

a) a base plate having a flat obverse surface;

b) a first driver for pushing and pulling a side surface of the sample holder placed on the obverse surface of the base plate in one direction in a plane substantially parallel to the obverse surface of the base plate; and c) a second driver for pushing and pulling a side surface of the sample holder placed on the obverse surface of the base plate, in a direction which is orthogonal to the direction in which the first driver pushes and pulls the side surface of the sample holder in the plane substantially parallel to the obverse surface of the base plate.

4. The time-of-flight mass spectrometer according to claim 3, wherein:

the base plate is a bottom plate of a sample chamber in which a sample is to be contained.

* * * * *